United States Patent [19]

Meyers

[11] 4,445,283

[45] May 1, 1984

[54] FOOTWEAR SOLE MEMBER

[75] Inventor: Stuart R. Meyers, Bronx, N.Y.

[73] Assignee: Synapco Ltd., Bronx, N.Y.

[21] Appl. No.: 196,020

[22] Filed: Oct. 10, 1980

Related U.S. Application Data

[62] Division of Ser. No. 970,010, Dec. 18, 1978, Pat. No. 4,297,797.

[51] Int. Cl.[3] ..... A43B 13/20

[52] U.S. Cl. ..... 36/29

[58] Field of Search ..... 36/44, 43, 28, 29; 128/594

[56] References Cited

U.S. PATENT DOCUMENTS

| | | | |
|---|---|---|---|
| 1,304,915 | 5/1919 | Spinney | 36/29 |
| 2,150,057 | 3/1939 | Fisch | 36/29 X |
| 2,177,116 | 10/1939 | Persichino | 128/594 |
| 2,527,414 | 10/1950 | Hallgren | 36/28 X |
| 2,631,387 | 3/1953 | Shaw | 36/43 X |
| 3,724,106 | 4/1973 | Magidson | 36/44 |
| 4,223,455 | 9/1980 | Vermeulen | 36/29 |

FOREIGN PATENT DOCUMENTS

| | | | |
|---|---|---|---|
| 1487256 | 5/1967 | France | 36/44 |
| 437051 | 11/1967 | Switzerland | 36/44 |
| 406529 | 3/1934 | United Kingdom | 36/44 |
| 510426 | 8/1939 | United Kingdom | 36/29 |

*Primary Examiner*—James Kee Chi

*Attorney, Agent, or Firm*—Samson B. Leavitt; Michael A. Leavitt

[57] ABSTRACT

A therapeutic shoe is disclosed wherein a sole member contains a plurality of differently sized air-tight compartments of differing compressibility so that the weight of the foot in the metatarsal and lateral regions compresses so as to form a supportive arch in the medial position. This therapeutic shoe provides supportive therapeutic aspects combined with cushioning aspects for comfort to the user. Suitable applications include the broad range of athletic uses including jogging shoes, and walking shoes as well.

6 Claims, 5 Drawing Figures

FOOTWEAR SOLE MEMBER

This is a division of application Ser. No. 970,010 filed Dec. 18, 1978 and now U.S. Pat. No. 4,297,797.

FIELD OF THE INVENTION

This invention relates to footwear. Specifically this invention relates to footwear which therapeutically supports and cushions the foot of the wearer.

BACKGROUND AND DESCRIPTION OF THE PRIOR ART

In the prior art it was desired to provide a shoe construction which simulated the natural walking conditions of primitive people by people today walking or running on hard, flat surfaces. The prior art sought, in effect, to provide a shoe which would be similar to running or walking on sand, wherein the sand fills in beneath the medial region of the foot as the lateral portion depresses on bearing the weight of the wearer.

One prior art attempt at achieving this effect was the "Earth Shoe." The Earth Shoe merely provides a recessed heel and a curved or rocker surface on the bottom of the shoe extending from a rectilinear generatrix which emanates from a point lying beneath the rear part of the location of the treading surface of the little toe obliquely rearwardly forming an angle of about 70° to 90° with a connecting line which extends from the point of the extreme part of the heel.

This form of footwear causes the foot during walking to shift the pressure on the ball of the foot onto the treading surface of the big toe instead of on the treading surface of the remaining four toes, thus allegedly providing a safer and less tiring walk.

As evident from the above discussion of the Earth Shoe, the footwear is fixed and does not accommodate changing conditions of the foot for the comfort of the user as to permit the foot and leg of the user to assume its natural position.

In Borgeas, U.S. Pat. No. 3,990,159, granted Nov. 9, 1976, there is described an improvement to the "Earth Shoe," wherein the foot supporting sole which is modifiable to reflect the changing conditions of the foot. While the Borgeas construction provided a readily modifiable insole, the forces reacting to the foot were the same resilient forces inherent in the foam rubber. And these resilient forces were uniform across the foam rubber insole.

Other prior art constructions were directed to cushions by permitting air flow patterns in relation to rubber sole, construction such as in Gilbert, U.S. Pat. No. 2,080,469, granted May 18, 1937; Famolare, Jr., U.S. Pat. No. 4,000,566, granted Feb. 22, 1977; Lee, U.S. Pat. No. 2,469,969, granted May 10, 1949; Russell, U.S. Pat. No. 3,087,261 granted Apr. 30, 1963; and Braun, U.S. Pat. No. 2,546,296, granted Mar. 27, 1951.

Now there is provided by the present invention, a shoe or shoe insole construction wherein there is dynamic action in proportion to the weight or force exerted by the wearer at different regions of the insole. The shoe or insole portion of the shoe provides a therapeutic supportive aspect to the foot, while cushioning and protecting the foot as well.

It is therefore a principal object of this invention to provide new and improved shoe which combines dynamic support and cushioning to the foot.

It is another object of this invention to provide a shoe as aforesaid which maintains the foot in an operable neutral position.

It is another object of this invention to provide a shoe, as immediately aforesaid, which will transfer the weight from one part of the foot to another.

It is still a further object of this invention to provide a shoe insole which dynamically forms an arch in situ with the weight distribution of the foot.

It is still a further object of this invention to provide a shoe which will diminish the likelihood of developing certain foot and leg deformities or conditions experienced in running or jogging on hard flat surfaces.

It is still a further object of this invention to provide a shoe which will exhibit improved comfort and support to persons having certain acquired or congenital deformities or conditions.

It is still a further object of this invention to provide a shoe which provides support and comfort to the foot particularly so in both the metatarsal head and lateral portions, while also providing improved stress relief in the medial region.

It is still a further object of this invention to provide a shoe insole construction which is lightweight.

It is still a further object of this invention to provide a therapeutic shoe which is readily constructed of relatively inexpensive materials, and yet is safe and practical in use.

It is still a further object of this invention to provide a shoe insole which is useful in a broad range of athletic footwear as well as normal walking footwear.

The aforesaid, as well as other objects and advantages, will become apparent from a reading of the following description, the adjoined claims and the accompanying drawings, in which:

DESCRIPTION OF THE PREFERRED EMBODIMENTS

Referring to FIGS. 1–5, there is shown the therapeutic shoe of this invention generally designated as numeral 10. As depicted in FIGS. 1–4, shoe 10 is shown as the insert with the over-structure comprising the conventional top, lacing and undersole not being shown for purposes of clarity; it being understood that such over-structural elements will conform to the specific type of shoe desired.

Figure 1:
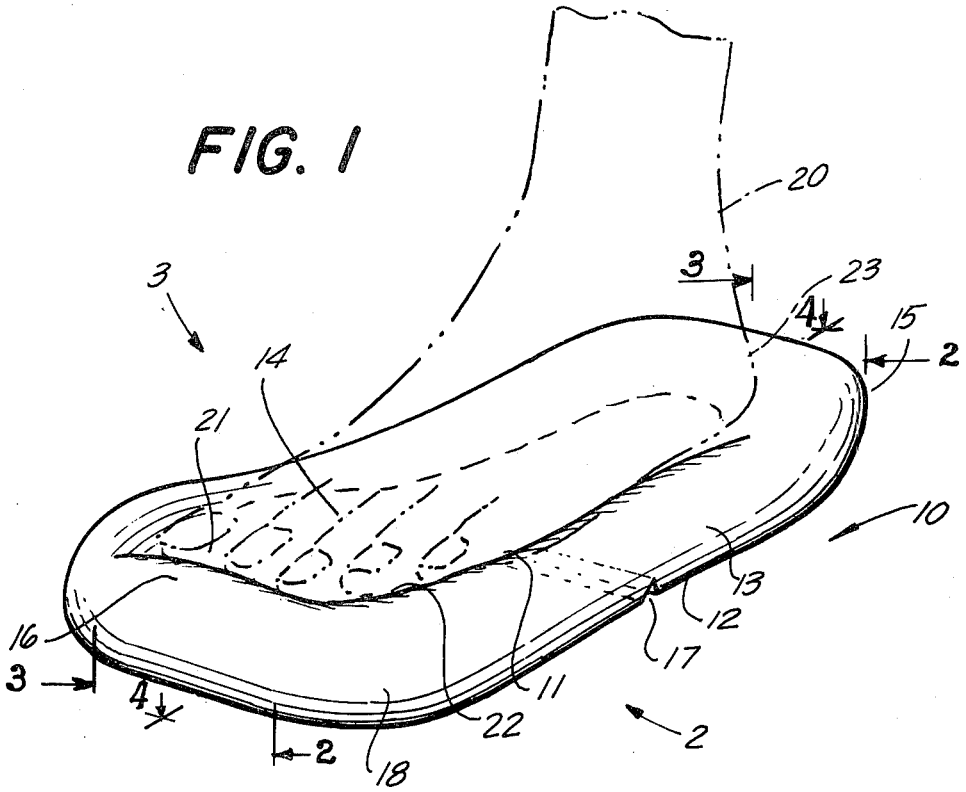
FIG. 1 is a perspective view of the shoe or shoe insole of this invention, showing the placement of a foot thereon in broken line; the insole being in the uncompressed condition.

Referring specifically to FIG. 1, shoe 10, comprises a top or foot-bearing portion 11, a sole or ground bearing portion 12, a lateral portion 13, a medial portion 14, a heel portion 15, and a raised toe portion 16 for reasons hereinafter more fully explained. Shoe 10 or more accurately ground bearing portion 12 is also formed with a groove or metatarsal split 17 to be more fully discussed hereinafter. All of said portions and the specific substructures forming same are enclosed in a high elastomeric sheathing 18, which stretches at and with the compression and extension experienced at the aforesaid respective shoe portions.

Figure 5:
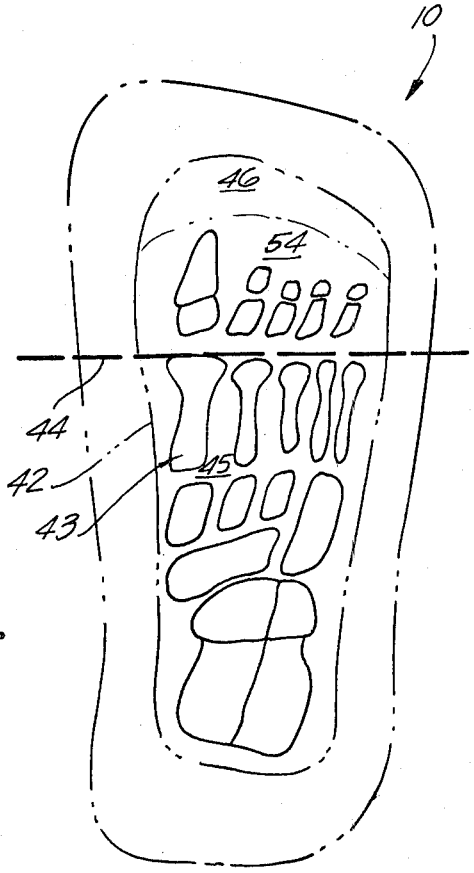
FIG. 5 is a plan schematic view of the insole of FIG. 1 depicting the placement of foot in relation to specific operable regions of the insole.

Shoe 10 is sized in relation to the foot intented for its use, but is proportional to the specific size of the foot, and is also specifically designed to the approximate weight of user. As shown in FIGS. 1 and 5, the user's foot 20 is disposed within the confines of the lateral, medial and heel portions. The user's toe 21 resides rearwardly of the raised top portion 16 as at interior curved portion 22, and the user's heel 23 resides forwardly of the raised portion 24 of heel portion 15.

Figure 2:
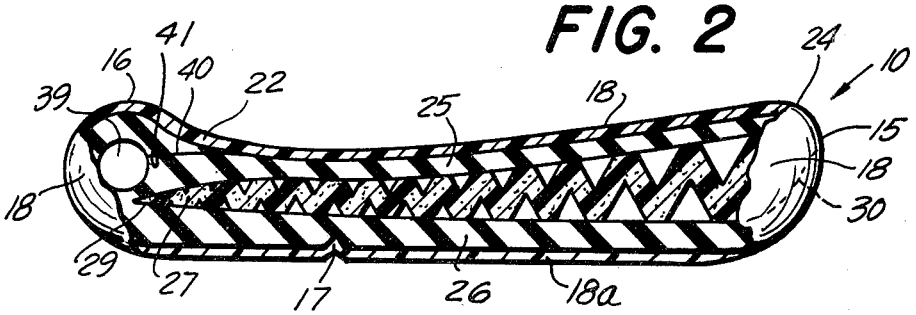
FIG. 2 is the lateral side view of the insole of FIG. 1, with fragmentary exposed portions of internal construction.
Figure 3:
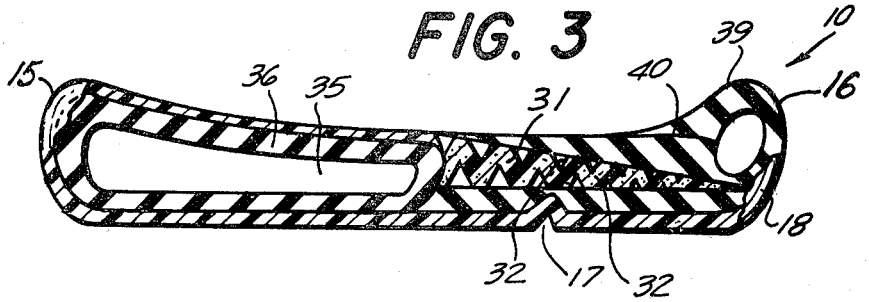
FIG. 3 is the medial side view of the insole of FIG. 1, with fragmentary exposed portion of the internal construction.
Figure 4:
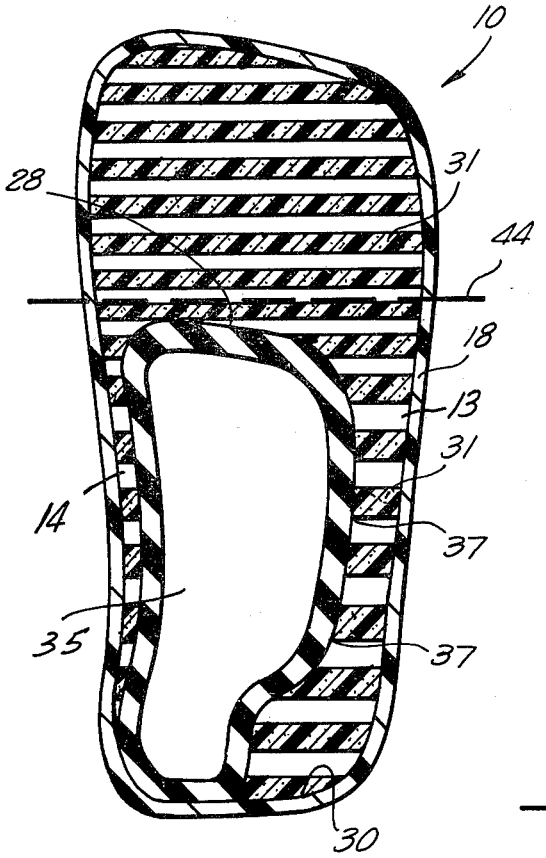
FIG. 4 is a transverse sectional view taken along line 4—4 of FIG. 3.

Referring to FIGS. 2–4, the internal structure of shoe 10 is shown and comprises a scarfed or tapered top rubber member 25 and a bottom scarfed or tapered rubber member 26 which form a wedge-shaped internal configuration 27 which configuration extends from the toe as at 29 to, on the medial side, just beyond the metatarsal region as at 28, and on the lateral side to the end of the heel reclined as at 30.

A plurality of transverse, angled ribs 31 formed of rubber are adhesively secured between members 25 and 26 so as to form a plurality of prism-shaped, air-tight chambers 32. Chambers 32 vary in size, and progressively increase in size from toe to heel. The ribs 31 may also increase in size, i.e. thickness, from toe to heel. Each chamber is filled with a fluid, customarily a gas such as air under pressure, and the pressure within each chamber generally increases from toe to heel; the thicker ribs being better suited to retain the greater air pressure. This concommitantly the heel region chambers are less compressible than the toe region chambers. In the aforesaid manner of construction, the weight of the foot will cause the fore-metatarsal portion to more compressibly yield than the aft-metatarsal portion, thus supporting the foot as well as cushioning same.

In the medial region there is a fluid (e.g. air)-filled, fluid-tight bag 35, formed of thick rubber walls 36. The walls 36 have a limited degree of elasticity so that the high pressure air in the bag 35 will not generally compress with the weight of the foot. Of course the wall 36 strength is determined by the pressure inside the bag 35 and the weight the user exerts on this portion. Bag 35 is adjacent to and adhesively sealed with ribs 31 so as to form an integral structure therewith as at 37. The prism-shaped chambers are designed to be more compressible than the bag 35 chamber, so that the weight of the foot in the toe, metatarsal heads, and lateral portions proportionately compresses those portions but does not likewise compress the medial bag portion, whereby the effect is to provide a firm arch-support in the medial region while cushioning the foot, particularly so in the front regions.

The toe region 16 is also of a specialized construction insofar as a thick-walled, fluid-filled, air-tight bag 39, protects and cushions the forward parts of the toes. Bag 39 is sealed to and made integral with member 25, as at 40 and 41.

In another aspect the present invention comprises a metatarsal split integrally formed with and as a part of the shoe construction. Specifically, bottom or sole member 26 is formed with transverse Vee-groove 17 wherein the bottom of groove 17 is parallel to and disposed below the metatarsal line 44. Sheath 18 overlies this groove 17. In walking, jogging or running the metatarsal groove 17 provides flexibility, and the shoe is thus a combined therapeutic supportive, cushioning and flexible construction.

Referring to FIG. 5, there is shown a schematic outline of the shoe as at 42 with the foot bone structure 43 placed thereon. A line 44 indicates the metatarsal split, and is parallel with the bottom of groove 17 (FIGS. 1–3). Circumscribed region 46 defines the aft toe cushion regions, while circumscribed region 54 defines the compressible toe, metatarsal head, and lateral positions, and region 45 defines the relatively non-compressible medial region.

Without wishing to be bound by any theory or mechanism it is believed that the more compressible lateral region in contradistinction to the medial region, and the raised heel portion, permit the correct parts of the foot namely the lateral aspect, metatarsal heads and digits to bear the weight in a cushioning manner, while the medial portion forms a supportive arch with the compression or depression of the aforesaid correct positions.

It is also within the contemplation of this invention to provide a specific contour to the foot bearing surface so to provide a mechanical advantages to certain regions such as the anterior compartment of the leg and also posterior muscle group and intrinsic muscle group by allowing the toes to grasp and exercise the leg mucles comfortably.

It is also within the scope of this invention to provide a dynamic system constituting fluid-filled chambers contained within the sole that redistributes weight automatically upon weight bearing pressure to the portions of the foot best adapted for bearing weight. The parts of the foot structured to bear the body weight are the lateral aspect, the fourth and fifth metatarsal shafts, bases and cuboid, and the first, second, third, fourth and fifth metatarsal heads distal to the surgical necks. In motion, as the weight on diffferent parts of the foot shifts, an automatic cushion of the fluid forms under the excessive weight-bearing segment thereby redistributing the weight. Therefore this dynamic system allows the foot to assume its correct neutral position where weight is on the lateral aspect and metatarsal heads and through the hallux yet it is sufficiently flexible to allow for individual deviations.

It is also within the scope of this invention to include a broader heel base for a firmer, steadier support of the body weight. It may also be described to have a toe box portion forward of and adjacent to the toe portions to eliminate rubbing by the toes against the top shoe portion which causes corns and toenail loss.

One preferred embodiment of the present invention is for the uniform distribution throughout the sole of variably compressible air-tight, air-filled chambers located between the inside of the shoe and the sole. The air-filled chambers are more compressible laterally than medially so that greater weight bearing will be on the lateral aspect.

Another preferred embodiment of the present invention is a therapeutic shoe having a sole member with a foot bearing portion and an oppositely disposed ground bearing portion which has a transversely disposed groove located below the metatarsal line of the foot. Without wishing to be bound by any theory or mechanism it is believed that this transverse groove thus disposed will allow for easier dorsiflexion and relieve stress in the muscles of the anterior compartment of the leg. The laces, if any, should also begin, in the top shoe portion, aft the metatarsal split so as not to inhibit dorsiflexion.

To achieve the aforementioned preferred embodiments, the chambers may be of any size or shape as long as the lateral aspect of the shoe is more compressible than the medial aspect. Therefore, chambers located laterally may contain more compressible contents or be smaller than chambers located medially. It is also to be understood that chambers may contain any compressible contents such as air, sand, gas to attain the desired result.

It is also understood that the invention may be made of any suitable material such as rubber, rubberized fabric, plastic, styrene-butadiene block polymers, butyl rubber or any equivalent elastomeric material.

The present invention may also be covered with any desirable material such as canvas, vinyl, leather or cotton.

The afore-described distal toe region is an optional aspect of the present construction, and it is within the contemplation of this invention that the shoe 10 not be formed with element 39, but may instead terminate at element 29.

The metatarsal phlangeal split 17, is in a preferred aspect directly below line 44. However, split 17 may more accurately contour the true metatarsal parabola and be slightly arched in this respect.

Raised heel portion 15 is found to relieve stress on the anterior and lateral muscular compartments of the leg thereby alleviating fatigue, and relieves stress on the posterior muscles as well.

It is to be borne in mind that the air bag 35 while shown as a simple bag construction may nevertheless be constructed as compartments, with sufficient fluid pressure to exert a force against the medial portion of the foot with compression in the lateral portion. Other materials and construction in addition to fluid-filled bags are also within the contemplation of this invention.

The air-tight chambers can be filled by any desirable means such as pumping contents into the chambers, filling the chambers under pressure or suctioning the contents into the chambers. Rubber cement may then be used to seal the chambers.

The shoe of the present invention is useful in athletic footwear such as in sneakers, jogging shoes, soccer shoes, rugby shoes, tennis shoes, basketball shoes, football shoes, ski boots, climbing boots and the like; as well as in normal walking footwear. A particularly preferred use with the present invention is in jogging shoes.

As various other modifications may be made to the present invention as will be known to those skilled in the art, the present invention is not to be construed as being limited to the specific details as heretofore shown and discussed but shall be construed by the appended claims.

What I claim is:

1. A footwear sole member formed essentially of material containing a plurality of compressible fluid-filled chambers and comprising toe, metatarsal head, remaining lateral and remaining medial portions, said toe, metatarsal head and remaining lateral portions being generally more compressible than said remaining medial portion.

2. A footwear sole member according to claim 1 wherein said material is elastomeric.

3. A footwear sole member according to claim 2 having a substantially wedge shaped configuration from heel to toe, the heel portion being higher than the toe portion.

4. A footwear sole member according to claim 1 wherein said chambers are fluid-tight.

5. A footwear sole member according to claim 2 wherein said chambers are fluid-tight.

6. A footwear sole member according to claim 3 wherein said chambers are fluid-tight.

* * * * *